US010165859B2

(12) United States Patent
Dickerson et al.

(10) Patent No.: US 10,165,859 B2
(45) Date of Patent: Jan. 1, 2019

(54) REFRIGERATOR APPLIANCE WITH A DRAWER SLIDE SYNCHRONIZER

(71) Applicant: Haier US Appliance Solutions, Inc., Wilmington, DE (US)

(72) Inventors: Alisa Marie Dickerson, Louisville, KY (US); Louis A. Wantland, Louisville, KY (US); Bagawathkumar Chellappan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/701,611

(22) Filed: Sep. 12, 2017

(65) Prior Publication Data

US 2017/0367480 A1 Dec. 28, 2017

Related U.S. Application Data

(63) Continuation-in-part of application No. 15/062,246, filed on Mar. 7, 2016.

(51) Int. Cl.

| | |
|---|---|
| ***A47B 88/45*** | (2017.01) |
| ***F25D 25/02*** | (2006.01) |
| ***A47B 88/10*** | (2006.01) |
| *F25D 23/02* | (2006.01) |
| *F25D 23/06* | (2006.01) |

(52) U.S. Cl.

CPC ..... *A47B 88/45* (2017.01); *A47B 88/10* (2013.01); *F25D 25/025* (2013.01); *A47B 2210/007* (2013.01); *A47B 2210/0032* (2013.01); *A47B 2210/0072* (2013.01); *A47B 2210/0083* (2013.01); *A47B 2210/175* (2013.01); *F25D 23/021* (2013.01); *F25D 23/067* (2013.01)

(58) Field of Classification Search

CPC ..... F25D 11/02; F25D 23/021; F25D 25/025; A47B 88/10; A47B 88/44; A47B 88/45

USPC ..... 312/330.1, 331, 334.1, 334.7, 334.8, 312/319.1, 401, 402

See application file for complete search history.

(56) References Cited

U.S. PATENT DOCUMENTS

| | | | | |
|---|---|---|---|---|
| 399,752 | A * | 3/1889 | Horrocks | A47B 88/10 312/331 |
| 2,607,094 | A * | 8/1952 | Nicosia | B65H 69/00 24/132 R |
| 3,687,505 | A * | 8/1972 | Fall | F16C 29/04 312/110 |
| 3,722,964 | A | 3/1973 | Chitester et al. | |
| 4,974,912 | A * | 12/1990 | Rask | E05D 15/58 312/110 |
| 8,414,094 | B2 * | 4/2013 | Chi | A47B 88/493 312/333 |
| 8,590,989 | B2 * | 11/2013 | Lowe | A47B 88/047 312/319.1 |

(Continued)

FOREIGN PATENT DOCUMENTS

| | | |
|---|---|---|
| WO | WO2015131778 A1 | 9/2015 |

*Primary Examiner* — James O Hansen
(74) *Attorney, Agent, or Firm* — Dority & Manning, P.A.

(57) ABSTRACT

A refrigerator appliance includes a drawer slide synchronizer with a first cable and a second cable. A first bearing is mounted to a first one of a pair of drawer slides, and a second bearing is mounted to a second one of the pair of drawer slides. The first and second cables contact the first bearing, and the first and second cables also contact the second bearing.

17 Claims, 13 Drawing Sheets

(56) References Cited

U.S. PATENT DOCUMENTS

| | | | | |
|---|---|---|---|---|
| 8,764,135 | B1 * | 7/2014 | Huang | A47B 88/40 312/331 |
| 8,936,332 | B2 | 1/2015 | Park et al. | |
| 2006/0087208 | A1 * | 4/2006 | Oh | F25D 25/025 312/402 |
| 2009/0045713 | A1 * | 2/2009 | Kunkle | F25D 25/025 312/402 |
| 2011/0005039 | A1 * | 1/2011 | Ganz | B29C 65/562 24/115 R |
| 2012/0242212 | A1 * | 9/2012 | Rotter | A61F 9/0017 312/402 |
| 2012/0262044 | A1 * | 10/2012 | Vulava | F25D 23/021 312/404 |
| 2015/0182779 | A1 * | 7/2015 | Dalebout | A63B 21/152 403/327 |

* cited by examiner

REFRIGERATOR APPLIANCE WITH A DRAWER SLIDE SYNCHRONIZER

CROSS-REFERENCE TO RELATED APPLICATION

The present application is a continuing application of U.S. patent application Ser. No. 15/062,246 of Dickerson et al. filed on Mar. 7, 2016 and entitled "A Refrigerator Appliance with a Drawer Slide Synchronizer," the entirety of which is incorporated by reference for all purposes.

FIELD OF THE INVENTION

The present subject matter relates generally to refrigerator appliances and drawer slide synchronizers for refrigerator appliances.

BACKGROUND OF THE INVENTION

Various types of consumer appliances are designed with pull-out compartment drawers. For example, a number of popular refrigerator styles have a freezer compartment with one or more pull-out drawers that span the width of the appliance and include storage baskets or bins. Examples of these refrigerators include Profile™ French door and Armoire style refrigerators from General Electric Appliances. The conventional pull-out drawers typically include side brackets that are mounted to slides of a slide mechanism that, in turn, has a base member mounted to the compartment liner.

Due to their substantial width, depth, and weight, the pull-out drawers are susceptible to misalignment between the sides when moving the drawer into and out of the appliance compartment, particularly if the door is grasped off-center and the pulling/closing force is applied non-parallel to the slide structure. This misalignment may lead to binding or "racking" of the drawer, which may make further movement of the drawer difficult and may also lead to an improper seal of the drawer in the closed position.

A known approach to minimize racking of the drawers is to synchronize the sliding movement of the opposite slide mechanisms with a rack and pinion system. Although the rack and pinion system is beneficial in minimizing the occurrence of racking, location of a shaft in the rack and pinion system is problematic in that it reduces the usable volume of the compartment for features such as bins, baskets, ice buckets, and so forth, especially when such devices are suspended above or below the drawer in a freezer compartment. In addition, rack and pinion systems can be noisy.

Accordingly, it would be desirable to provide an anti-racking system for pull-out drawers that occupies limited space below or behind the drawer while quietly reducing racking of the drawer.

BRIEF DESCRIPTION OF THE INVENTION

The present provides a refrigerator appliance with a drawer slide synchronizer. The drawer slide synchronizer includes a first cable and a second cable. A first bearing is mounted to a first one of a pair of drawer slides, and a second bearing is mounted to a second one of the pair of drawer slides. The first and second cables contact the first bearing, and the first and second cables also contact the second bearing. Additional aspects and advantages of the invention will be set forth in part in the following description, or may be apparent from the description, or may be learned through practice of the invention.

In a first example embodiment, a refrigerator appliance defines a vertical direction, a lateral direction and a transverse direction that are mutually perpendicular. The refrigerator appliance includes a cabinet that extends between a top portion and a bottom portion along the vertical direction. The cabinet also extends between a first side portion and a second side portion along the lateral direction. The cabinet further extends between a front portion and a back portion along the transverse direction. The cabinet defining a chilled chamber. A chilled chamber drawer assembly includes a chilled chamber door and a pair of drawer slides mounted to the cabinet at the chilled chamber of the cabinet. The drawer slides of the pair of drawer slides couple the chilled chamber door to the cabinet such that the chilled chamber door is translatable relative to the cabinet on the pair of drawer slides along the transverse direction. A drawer slide synchronizer couples the drawer slides of the pair of drawer slides together. The drawer slide synchronizer includes a first cable that extends between a first end portion and a second end portion. The first end portion of the first cable is mounted at the first side portion of the cabinet and the back portion of the cabinet. The second end portion of the first cable is mounted at the second side portion of the cabinet and the front portion of the cabinet. A second cable also extends between a first end portion and a second end portion. The first end portion of the second cable is mounted at the second side portion of the cabinet and the back portion of the cabinet. The second end portion of the second cable is mounted at the first side portion of the cabinet and the front portion of the cabinet. A first bearing is mounted to a first one of the pair of drawer slides such that the first bearing is fixed relative to the chilled chamber door. The first and second cables contact the first bearing. A second bearing is mounted to a second one of the pair of drawer slides such that the second bearing is fixed relative to the chilled chamber door. The first and second cables contact the second bearing.

In a second example embodiment, a bottom-mount refrigerator appliance defines a vertical direction, a lateral direction and a transverse direction that are mutually perpendicular. The refrigerator appliance includes a cabinet that extends between a top portion and a bottom portion along the vertical direction. The cabinet also extends between a first side portion and a second side portion along the lateral direction. The cabinet further extends between a front portion and a back portion along the transverse direction. A freezer chamber of the cabinet is disposed at the bottom portion of the cabinet. A freezer drawer assembly includes a freezer door and a pair of full extension drawer slides mounted to the cabinet at the freezer chamber of the cabinet. The drawer slides of the pair of drawer slides couple the freezer door to the cabinet such that the freezer door is translatable relative to the cabinet on the pair of drawer slides along the transverse direction. A drawer slide synchronizer couples the drawer slides of the pair of drawer slides together. The drawer slide synchronizer includes a first cable that extends between a first end portion and a second end portion. The first end portion of the first cable fixed relative to the cabinet at the first side portion of the cabinet and the back portion of the cabinet. The second end portion of the first cable fixed relative to the cabinet at the second side portion of the cabinet and the front portion of the cabinet. A second cable also extends between a first end portion and a second end portion. The first end portion of the second cable fixed relative to the cabinet at the second side portion of the cabinet and the back portion of the cabinet. The second end portion of the second cable fixed relative to the cabinet at the first side portion of the cabinet and the front portion of the cabinet. A first bearing is mounted to a first one of the pair of full extension drawer slides such that the first bearing is translatable relative to the cabinet along the transverse direction. The first and second cables contact the first bearing. A second bearing is mounted to a second one of the pair of full extension drawer slides such that the second bearing is translatable relative to the cabinet along the transverse direction. The first and second cables contact the second bearing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
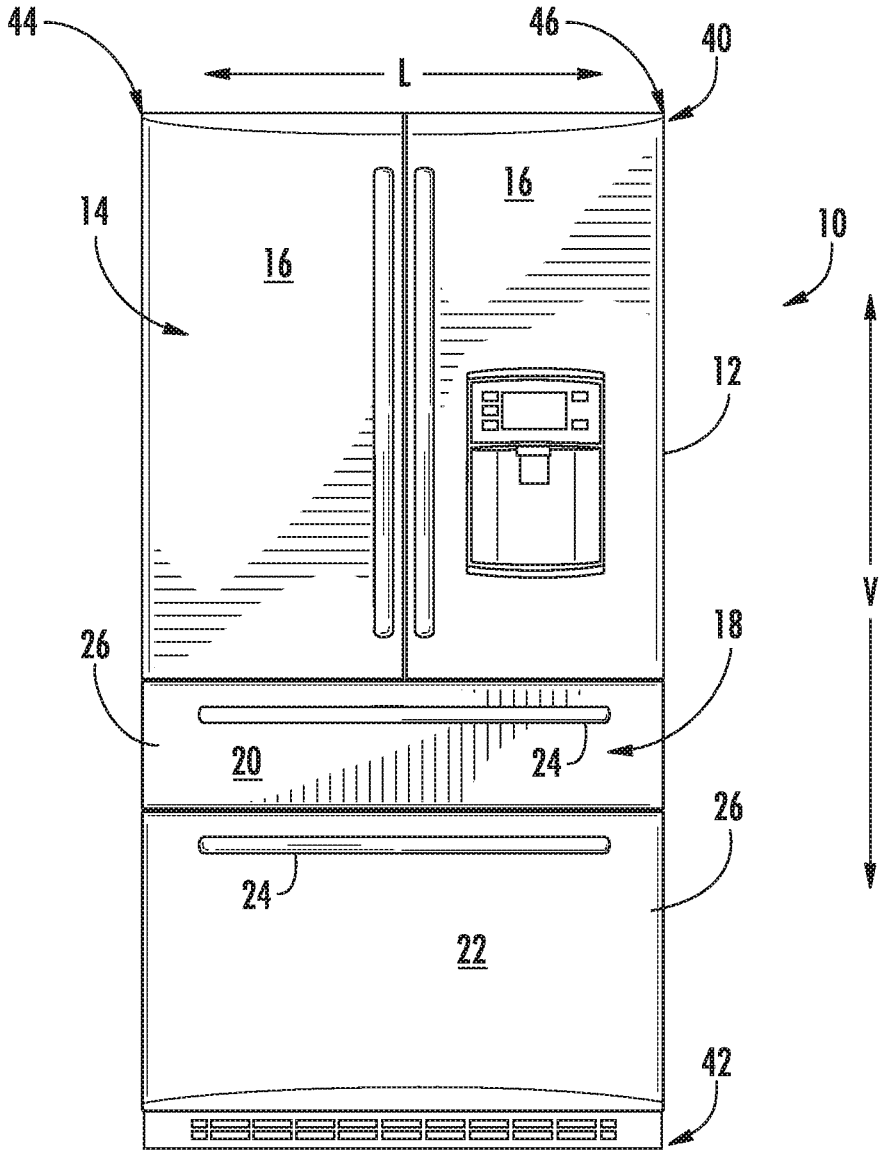
FIG. 1 provides a perspective view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a consumer appliance 10 in a form of a refrigerator appliance 10 that may incorporate one or more pull-out drawers in accordance with aspects of the present subject matter. While described in greater detail below in the context of refrigerator appliance 10, it should be understood that the present subject matter may be used in or within any other suitable appliance, such as a freezer, an oven, a washing machine, a dryer, a range, etc., in alternative example embodiments. In addition, the terms "refrigerator" or "refrigerator appliance" are also used in a generic sense herein to encompass any manner of refrigeration appliance, such as a freezer, refrigerator/freezer combination and any style or model of conventional refrigerator. In the illustrated embodiment, refrigerator appliance 10 is depicted as an upright refrigerator having a cabinet or casing 12 that defines a number of internal storage compartments. In particular, refrigerator appliance 10 includes an upper fresh-food compartment 14 having doors 16 and lower freezer compartment 18 having upper drawer 20 and lower drawer 22. Drawers 20, 22 are "pull-out" drawers in that they can be manually moved into and out of freezer compartment 18 on suitable slide mechanisms, as depicted in FIG. 2.

Figure 2:
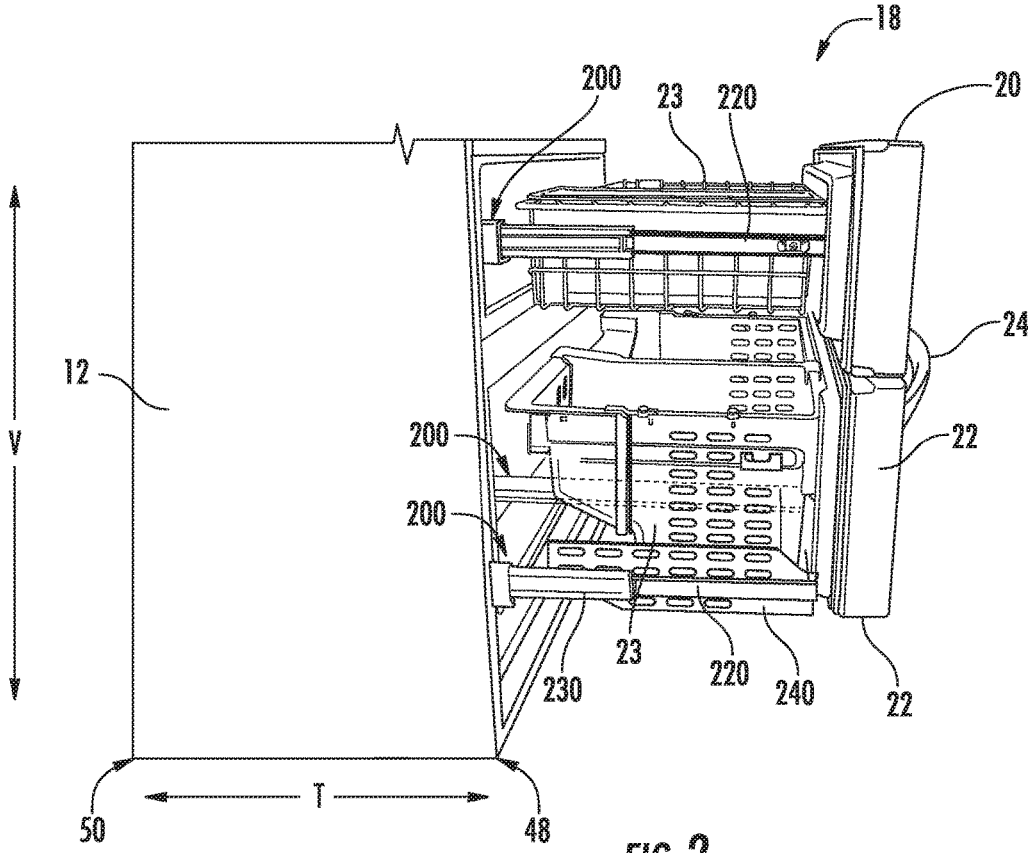
FIG. 2 provides a perspective view of a freezer compartment of the example refrigerator appliance of FIG. 1 with pull-out drawers in an open position.

As may be seen in FIGS. 1 and 2, refrigerator appliance 10 defines a vertical direction V, a lateral direction L and a transverse direction T. The vertical direction V, the lateral direction L and the transverse direction T are mutually perpendicular and form an orthogonal direction system. Casing 12 extends between a top portion 40 and a bottom portion 42 along the vertical direction V. Casing 12 also extends between a first side portion 44 and a second side portion 46 along the lateral direction L. Casing 12 further extends between a front portion 48 and a back portion 50 along the transverse direction T. Fresh-food compartment 14 of casing 12 is disposed at or adjacent top portion 40 of casing 12, and freezer compartment 18 of casing 12 is disposed at or adjacent bottom portion 42 of casing 12. Drawers 20, 22 are translatable relative to casing 12 along the transverse direction T.

FIG. 2 depicts freezer compartment 18 of refrigerator appliance 10 with upper drawer 20 and lower drawer 22 pulled out of freezer compartment 18. Each drawer 20, 22 may include any manner of storage basket or bin 23. Each of drawers 20, 22 essentially spans the width of freezer compartment 18 and moves into and out of freezer compartment 18 via a respective drawer slide 200, which are widely used and known in the art and need not be described in great detail herein. Each drawer 20, 22 includes a handle 24 mounted to a front panel 26 whereby the drawer is moved into and out of freezer compartment 18 on drawer slides 200 by a consumer grasping and pulling or pushing on handle 24. As discussed above, an off-center pull/push force can result in racking of drawer 20, 22 relative to casing 12, particularly for the heavier lower drawer 22.

Figure 3:
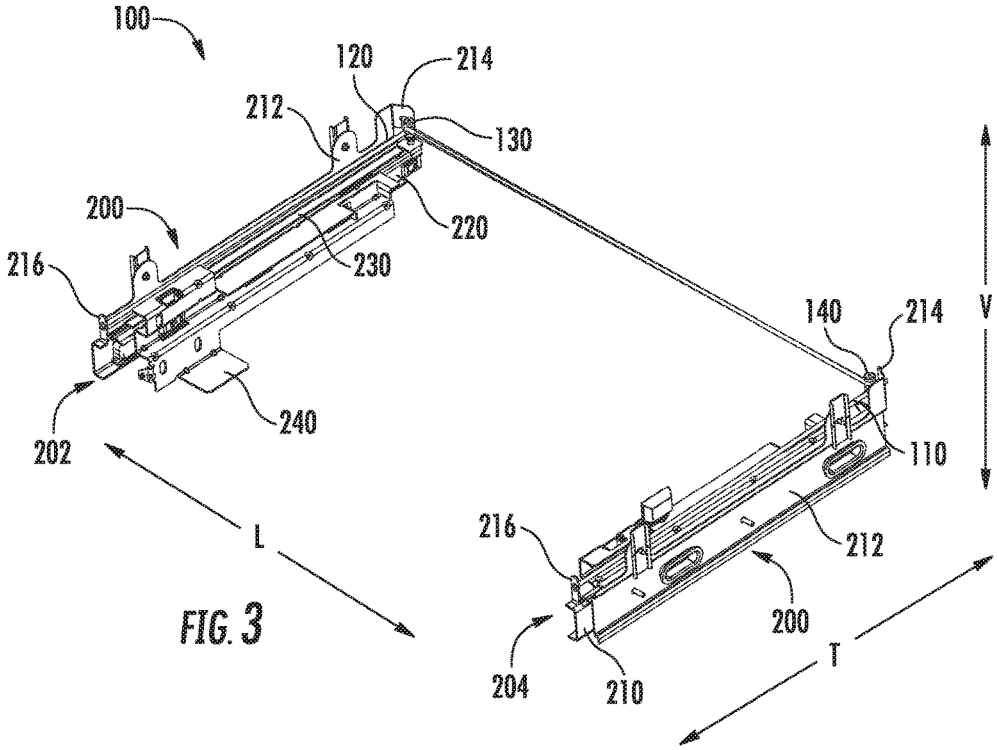
FIG. 3 provides a perspective view of a drawer slide synchronizer according to an example embodiment of the present subject matter and a pair of drawer slides of the example refrigerator appliance of FIG. 1 with the pair of drawer slides shown in a retracted configuration.
Figure 4:
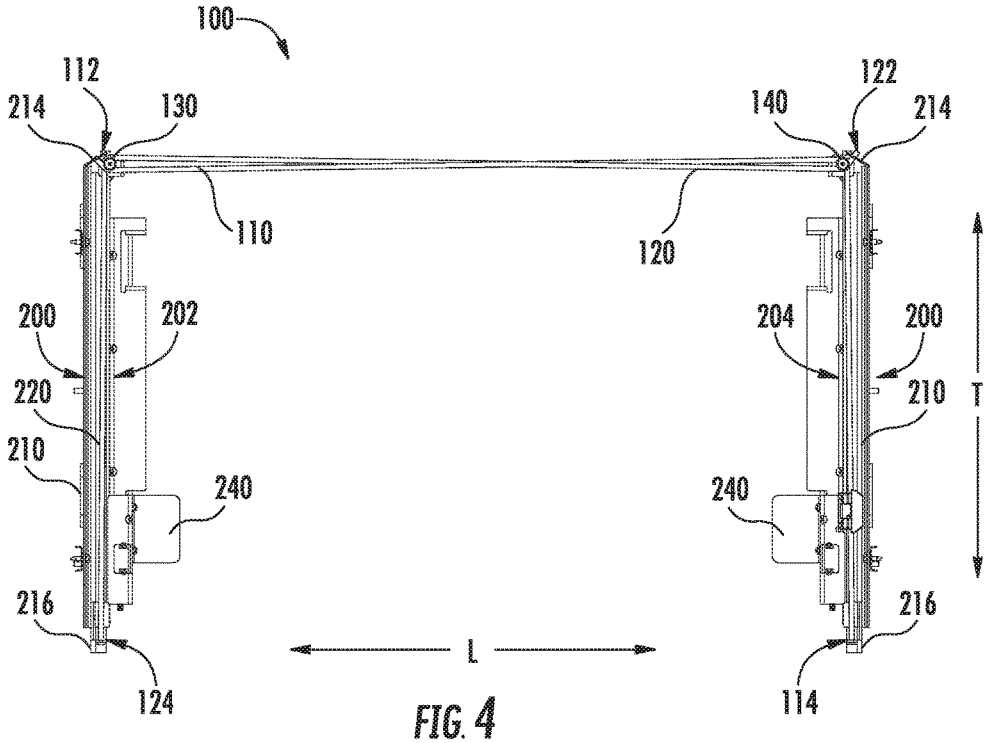
FIG. 4 provides a top, plan view of the example drawer slide synchronizer and the pair of drawer slides in the retracted configuration.
Figure 5:
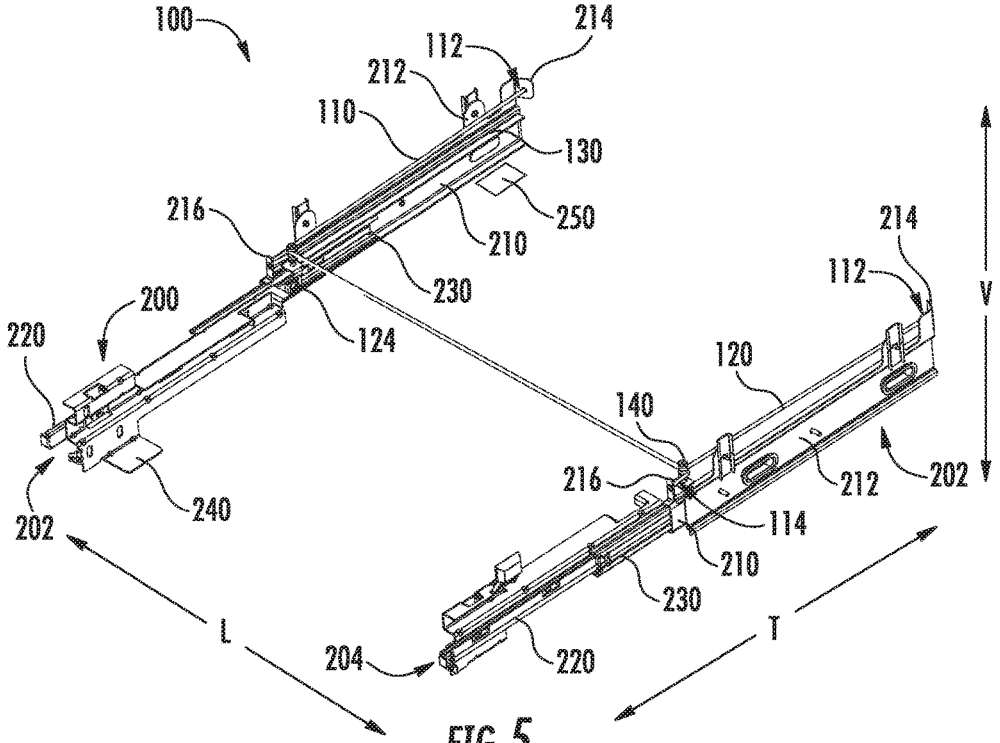
FIG. 5 provides a perspective view of the example drawer slide synchronizer and the pair of drawer slides with the pair of drawer slides shown in an extended configuration.
Figure 6:
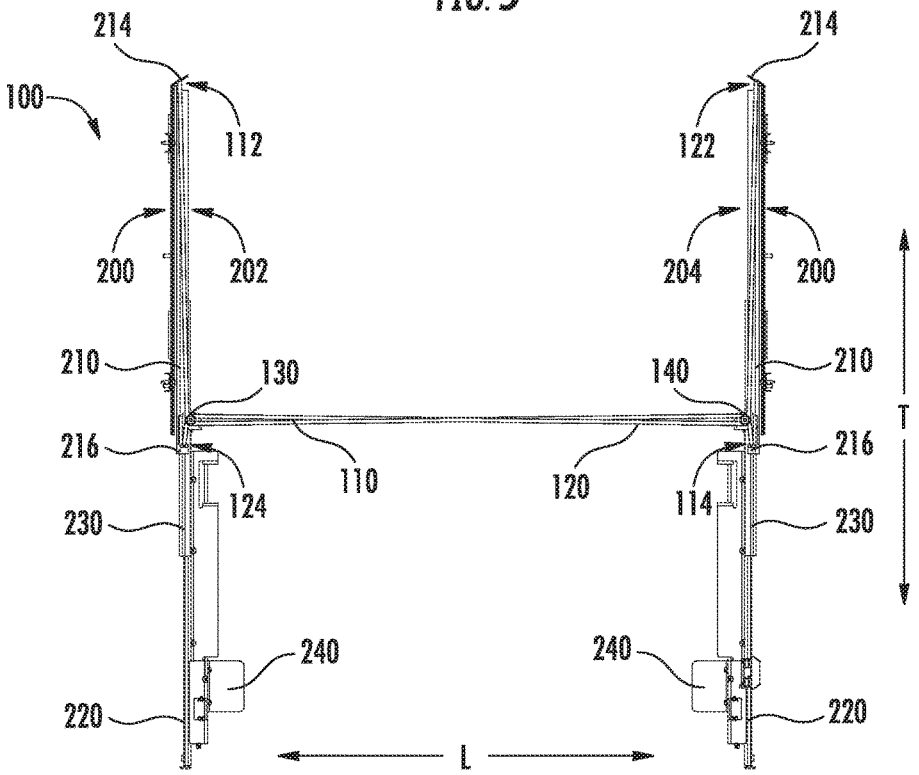
FIG. 6 provides a top, plan view of the example drawer slide synchronizer and the pair of drawer slides in the extended configuration.

FIGS. 3 and 5 provide perspective views of a drawer slide synchronizer 100 according to an example embodiment of the present subject matter. FIGS. 4 and 6 provide top, plan views of drawer slide synchronizer 100. Drawer slide synchronizer 100 couples drawer slides of a pair of drawer slides 200 together. Thus, drawer slides 200 may extend and/or retract at a common rate, e.g., along the transverse direction T, during translation of drawers 20, 22 relative to casing 12 via drawer slide synchronizer 100. Drawer slides 200 are shown in a retracted configuration in FIGS. 3 and 4, and drawer slides 200 are shown in an extended configuration in FIGS. 5 and 6. Operation of drawer slide synchronizer 100 to synchronize motion of drawer slides 200 between the retracted and extended configurations is discussed in greater detail below in the context of FIGS. 3-6.

As shown in FIG. 5, drawer slides 200 are spaced apart from each other, e.g., along the lateral direction L. Drawer slides 200 may be mounted to casing 12 within freezer compartment 18. For example, each drawer slide of drawer slides 200 may be mounted to casing 12 at opposite side of freezer compartment 18 (for example on liner sidewalls within freezer compartment 18).

Each drawer slide of drawer slides 200 may be a full extension draw slide and may include a first or outer slide 210, a second or inner slide 220 and a third or intermediate slide 230. Outer slide 210 is fixed relative to casing 12. For example, drawer slides 200 may also include an outer slide bracket or housing 212. Outer slide housing 212 may be mounted to casing 12, e.g., with fasteners or any other suitable mechanism. In turn, outer slide 210 may be mounted to outer slide housing 212. Thus, outer slide 210 may be fixed relative to casing 12 via outer slide housing 212. In alternative example embodiments, each drawer slide of drawer slides 200 may be a partial extension drawer slide and may include only outer slide 210 and inner slide 220, or each drawer slide of drawer slides 200 may include four or more total slides.

Inner slide 220 is mounted to front panel 26 of drawers 20, 22. Thus, inner slide 220 may be fixed relative to front panel 26 of drawers 20, 22. Inner slide 220 is received within intermediate slide 230, and intermediate slide 230 is received within outer slide 210. Intermediate slide 230 and inner slide 220 are slidable or moveable along the transverse direction T relative to outer slide 210 (e.g., and casing 12). In addition, inner slide 220 is slidable or moveable along the transverse direction T relative to intermediate slide 230. Thus, intermediate slide 230 may be slidable or movable relative to front panel 26 of drawers 20, 22. Ball bearings may extend between outer slide 210 and intermediate slide 230 may also extend between intermediate slide 230 and outer slide 210 in order to facilitate movement of inner and intermediate slides 220, 230 along the transverse direction T relative to outer slide 210. As may be seen in FIGS. 3 and 5, inner and intermediate slides 220, 230 move linearly into and out of outer slide 210, and inner and intermediate slides 220, 230 may also telescope relative to each other. Flanges 240 on inner slide 220 may also extend under storage bin 23, and storage bin 23 may rest on flanges 240.

Drawer slide synchronizer 100 includes a first cable 110, a second cable 120, a first bearing 130 and a second bearing 140. As may be seen in FIGS. 4 and 6, first cable 110 extends between a first end portion 112 and a second end portion 114. First end portion 112 of first cable 110 may be mounted and disposed at or adjacent first side portion 44 of casing 12 and back portion 50 of casing 12, e.g. such that first end portion 112 of first cable 110 is fixed relative to casing 12. Conversely, second end portion 114 of first cable 110 may be mounted and disposed at or adjacent second side portion 46 of casing 12 and front portion 48 of casing 12, e.g. such that second end portion 114 of first cable 110 is fixed relative to casing 12. Thus, first and second end portions 112, 114 of first cable 110 may be disposed and fixed relative to casing 12 at opposite sides of freezer compartment 18, e.g., along both the lateral direction L and transverse direction T, and first and second end portions 112, 114 of first cable 110 may be spaced apart from each other, e.g., along both the lateral direction L and transverse direction T.

Second cable 120 also extends between a first end portion 122 and a second end portion 124. First end portion 122 of second cable 120 may be mounted and disposed at or adjacent second side portion 46 of casing 12 and back portion 50 of casing 12, e.g. such that first end portion 122 of second cable 120 is fixed relative to casing 12 and positioned opposite first end portion 112 of first cable 110 about freezer compartment 18 along the lateral direction L. Conversely, second end portion 124 of second cable 120 may be mounted and disposed at or adjacent first side portion 44 of casing 12 and front portion 48 of casing 12, e.g. such that second end portion 124 of second cable 120 is fixed relative to casing 12 and positioned opposite second end portion 114 of first cable 110 about freezer compartment 18 along the lateral direction L. Like first cable 110, first and second end portions 122, 124 of second cable 120 may be disposed and fixed relative to casing 12 at opposite sides of freezer compartment 18, e.g., along both the lateral direction L and transverse direction T, and first and second end portions 122, 124 of second cable 120 may be spaced apart from each other, e.g., along both the lateral direction L and transverse direction T.

As may be seen in FIGS. 3 and 5, first end portion 112 of first cable 110 and first end portion 122 of second cable 120 may be mounted to a respective outer slide holder 212 of drawer slides 200, e.g., a rear projection 214 on outer slide holder 212 at back portion 50 of casing 12. Rear projection 214 may be positioned behind outer slide 210, e.g., along the transverse direction T. In alternative example embodiments, first end portion 112 of first cable 110 and first end portion 122 of second cable 120 may be mounted to a respective outer slide 210 of drawer slides 200, e.g., with rear projection 214 formed on outer slide 210. In other alternative example embodiments, first end portion 112 of first cable 110 and first end portion 122 of second cable 120 may be mounted directly to casing 12, e.g., with fasteners, clips, etc. behind outer slide 210.

Second end portion 114 of first cable 110 and second end portion 124 of second cable 120 may be mounted to a respective outer slide holder 212 of drawer slides 200, e.g., a front projection 216 on outer slide holder 212 at front portion 48 of casing 12. Front projection 216 may be positioned in front of outer slide 210, e.g., along the transverse direction T. In alternative example embodiments, second end portion 114 of first cable 110 and second end portion 124 of second cable 120 may be mounted to a respective outer slide 210 of drawer slides 200, e.g., with front projection 216 formed on outer slide 210. In other alternative example embodiments, second end portion 114 of first cable 110 and second end portion 124 of second cable 120 may be mounted directly to casing 12, e.g., with fasteners, clips, etc. in front of outer slide 210 along the transverse direction T.

First bearing 130 is mounted to a first one 202 of drawer slides 200. In particular, first bearing 130 may be fixed relative to front panel 26 of drawers 20, 22 on first one 202 of drawer slides 200, and first bearing 130 may move along the transverse direction T with front panel 26 of drawers 20, 22 during opening and closing of drawers 20, 22. Second bearing 140 is mounted to a second one 204 of drawer slides 200. In particular, second bearing 140 may be fixed relative to front panel 26 of drawers 20, 22 on second first one 204 of drawer slides 200, and second bearing 140 may move along the transverse direction T with front panel 26 of drawers 20, 22 during opening and closing of drawers 20, 22. First and second bearings 130 may be rotatable on drawer slides 200 in certain example embodiments.

First and second cables 110, 120 each contact first bearing 130. For example, as shown in FIG. 6, first cable 110 may first contact and turn on first bearing 130 and then contact and turn on second bearing 140 between first and second end portions 112, 114 of first cable 110. First and second cables 110, 120 also each contact second bearing 140. For example, as shown in FIG. 5, second cable 120 may first contact and turn on second bearing 140 and then contact and turn on first bearing 130 between first and second end portions 122, 124 of second cable 120. Thus, first and second cables 110, 120 may cross each other between drawer slides 200, as shown in FIG. 6.

Drawer slide synchronizer 100 assists with synchronizing motion of drawer slides 200 as drawer slides 200 shift between the retracted and extended configurations. For example, first and second cables 110, 120 and first and second bearings 130, 140 assist with synchronizing motion of drawer slides 200, e.g., such that inner slides 220 of drawer slides 200 translate along transverse direction at a common speed as drawer slides 200 shift between the retracted and extended configurations.

From the extended configuration shown in FIGS. 5 and 6, a user may push on one side of front panel 26 of drawers 20, 22. The off-center application of force onto front panel 26 of drawers 20, 22 may urge drawer slides 200 to "rack" or bind, but drawer slide synchronizer 100 assists with synchronizing motion of drawer slides 200. In particular, as inner slide 220 of first one 202 of drawer slides 200 moves towards back portion 50 of casing 12, first bearing 130 may push against second cable 120 such that second cable 120 goes in tension and pulls second bearing 140 back with first bearing 130 along the transverse direction T. Thus, as one of first and second bearings 130, 140 pushes on first or second cables 110, 120 and requires more cable length, the additional cable length is taken from the across freezer compartment 18, which causes the opposite drawer slide 200 to be pulled closed simultaneously. With little slack in first or second cables 110, 120, one of drawer slides 200 cannot extend or close without the other of drawer slide 200 doing the same. In such a manner, drawer slide synchronizer 100 can quietly synchronize motion of drawer slides 200, e.g., without the noise associated with rack and pinion system and/or while occupying little volume within freezer compartment 18.

Figure 7:
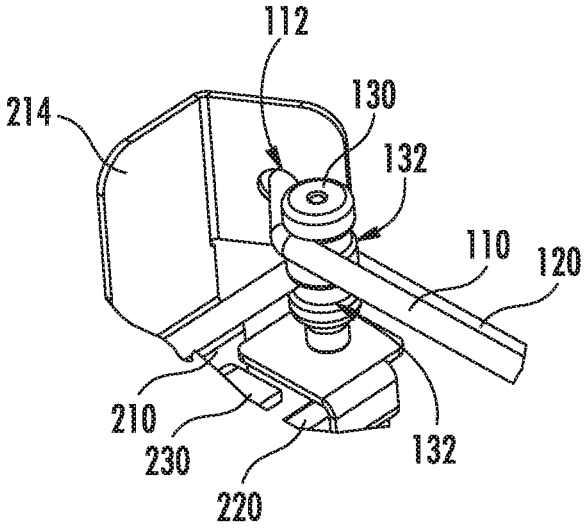
FIG. 7 provides a perspective view of a bearing of the example drawer slide synchronizer of FIG. 3.
Figure 8:
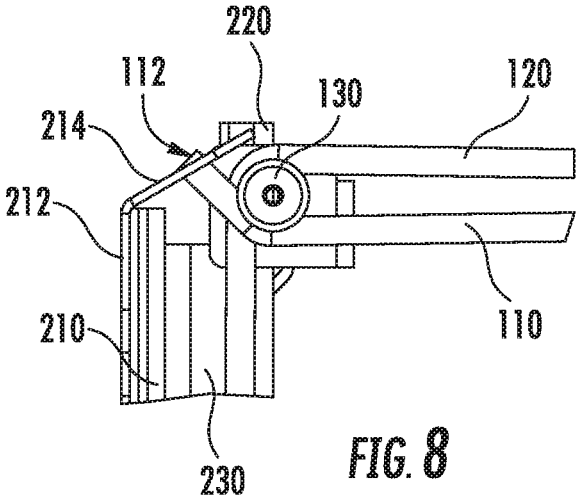
FIG. 8 provides a top, plan view of the bearing of FIG. 7.

FIG. 7 provides a perspective view of first bearing 130. FIG. 8 provides a top, plan view of first bearing 130. As shown in FIGS. 7 and 8, first bearing 130 may be a pulley, e.g., that is rotatable and/or defines a pair of grooves 132. First and second cables 110, 120 are each positioned within a respective one of grooves 132. Grooves 132 may be spaced apart from each other along the vertical direction V. Second bearing 140 may be constructed in the same or similar manner.

Figure 9:
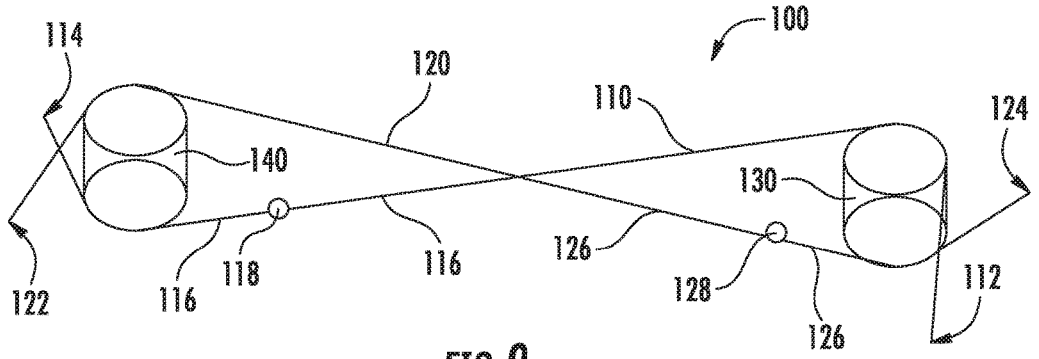
FIG. 9 provides a schematic view of a winding pattern for a pair of cables and bearings according to an example embodiment of the present subject matter.

FIG. 9 provides a schematic view of a winding pattern for a pair of cables and bearings according to an example embodiment of the present subject matter. For example as shown in FIG. 9, first and second cables 110, 120 of drawer slide synchronizer 100 may be wound in the pattern shown in FIG. 9. As shown in FIG. 9, first cable 110 includes a pair of cable segments 116. Cable segments 116 of first cable 110 are coupled to each other between drawer slides 200. Second cable 120 also includes a pair of cable segments 126. Cable segments 126 of second cable 120 are coupled to each other between drawer slides 200.

A joint or connection 118 between cable segments 116 of first cable 110 may be positioned proximate second side portion 46 of casing 12. Conversely, a joint or connection 128 between cable segments 126 of second cable 120 may be positioned proximate first side portion 44 of the casing 12. Thus, connection 118 of first cable 110 and connection 128 of second cable 120 may be spaced apart from each other along the lateral direction L and may not contact or slide over first bearing 130 and/or second bearing 140 as drawer slides 200 shift between the retracted and extended configurations.

Figure 10:
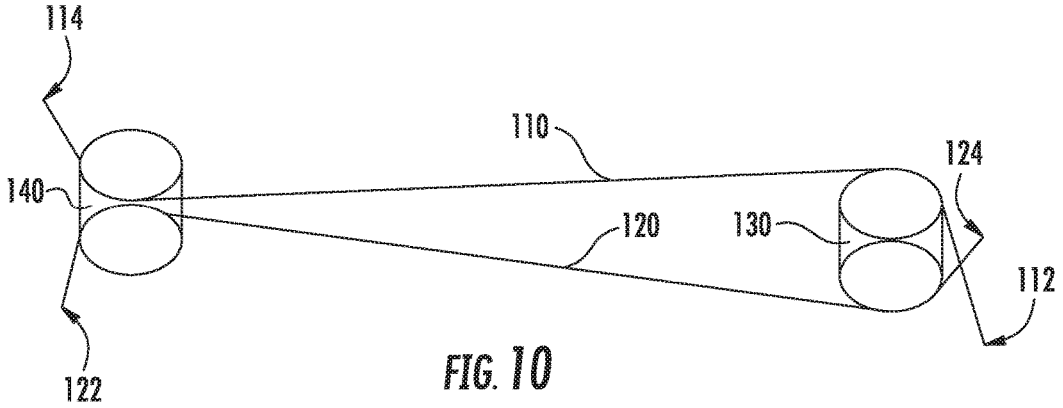
FIG. 10 provides a schematic view of a winding pattern for a pair of cables and bearings according to another example embodiment of the present subject matter.

FIG. 10 provides a schematic view of a winding pattern for a pair of cables and bearings according to another example embodiment of the present subject matter. For example as shown in FIG. 10, first and second cables 110, 120 of drawer slide synchronizer 100 may be wound in the pattern shown in FIG. 10. First and second cables 110, 120 do not cross each other between drawer slides 200 in the winding pattern shown in FIG. 10.

Turning back to FIG. 5, drawer slides 200 may also include a closure mechanism 250 (shown schematically in FIG. 5). Closure mechanism 250 may be disposed outside of and adjacent to outer slide 210. In particular, closure mechanism 250 may be disposed outside of outer slide 210 at or adjacent back portion 50 of casing 12. Closure mechanism 250 may assist with pulling drawers 20, 22 towards the closed configuration. Closure mechanism may be any suitable type of external closure mechanism. For example, closure mechanism 250 may be constructed in the same or similar manner to the closure mechanism described in U.S. Pat. No. 8,414,094 of Chi et al. entitled "Drawer System Slide Assemblies and Closure Mechanisms," the disclosure of which is hereby incorporated by reference in its entirety for all purposes. Drawer slides 200 may also include closure mechanism 250 due to the absence of a rack and pinion system between drawer slides 200.

Figure 11:
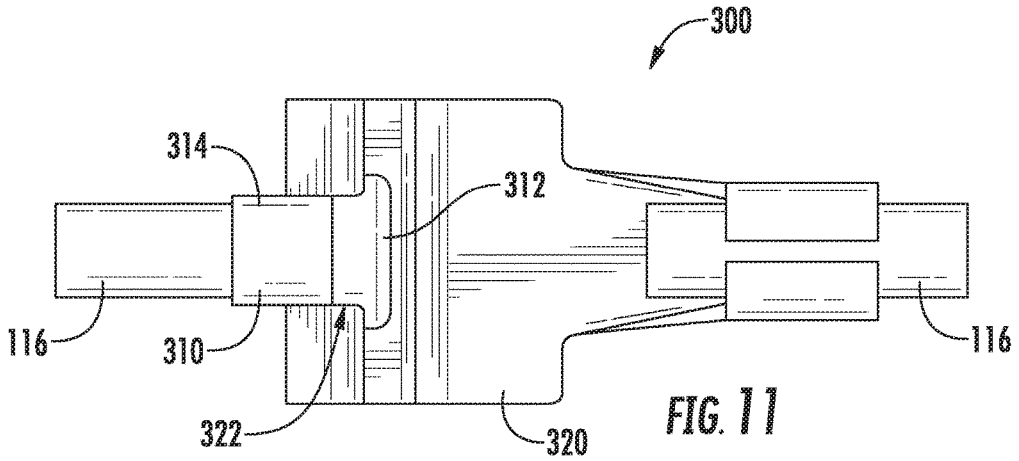
FIGS. 11 and 12 show a connector between two cable segments according to a first example embodiment of the present subject matter.
Figure 12:
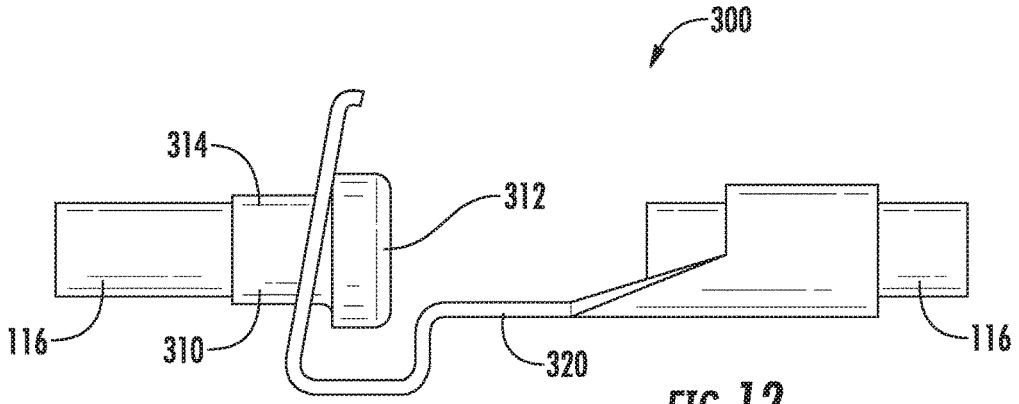

As noted above, cable segments 116 of first cable 110 are coupled to each other between drawer slides 200. FIGS. 11 and 12 show a connector 300 between cable segments 116 of first cable 110. It will be understood that connector 300 may also be used to connect cable segments 126 of second cable 120 between drawer slides 200. Connector 300 includes a block 310 and a hook 320. Block 310 is mounted to one of cable segments 116 of first cable 110, and hook 320 is mounted to the other of cable segments 116 of first cable 110. Block 310 is received within a slot 322 of hook 320 to connect cable segments 116 of first cable 110. Thus, it will be understood that a head 312 of block 310 is larger than slot 322 of hook 320 while a shaft 314 of block 310 is equally sized or smaller than slot 322 of hook 320. For example, as shown in FIGS. 11 and 12, head 312 of block 310 may be cylindrical with a diameter that is larger than a width of slot 322 while shaft 314 of block 310 may be cylindrical with a diameter that is equal to or smaller than the width of slot 322. Thus, shaft 314 of block 310 may be received within slot 322 while head 312 of block 310 impacts or rests against hook 320. In such a manner, the interface between block 310 and hook 320 may couple cable segments 116 of first cable 110 together and prevent cable segments 116 of first cable 110 from separating.

Block 310 and hook 320 may each be clamped or pinched onto a respective one of cable segments 116 of first cable 110, as shown in FIGS. 11 and 12. In alternative example embodiments, block 310 and hook 320 may each be tied, adhered, welded, or otherwise suitably attached to the respective one of cable segments 116 of first cable 110. When block 310 and hook 320 are each mounted to the respective one of cable segments 116 of first cable 110, cable segments 116 of first cable 110 may be positioned coaxial with one another at connector 300. Coaxial positioning of cable segments 116 of first cable 110 may facilitate uniform force transmission through connector 300. Connector 300 may also allow adjustment of tension in first cable 110, e.g., between cable segments 116 of first cable 110.

Figure 21:
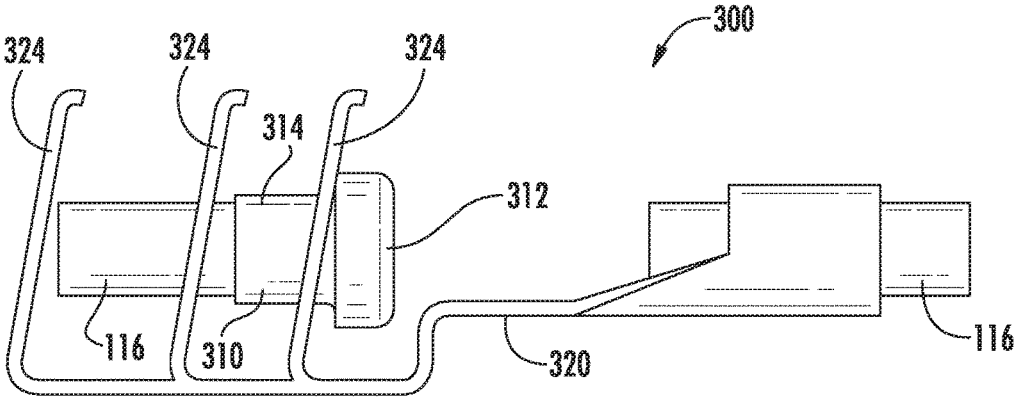
FIG. 21 provides a top, plan view of a connector between two cable segments with a tension adjuster according to a first example embodiment of the present subject matter.

Connector 300 may also include features for allowing adjustment of tension in first cable 110, e.g., between cable segments 116 of first cable 110. For example, turning to FIG. 21, hook 320 may have a plurality of blades 324, and each blade 324 may have a respective slot 322 within which shaft 314 of block 310 is receivable. Head 312 of block 310 may be positioned on any one of blades 324. During assembly of drawer slide synchronizer 100, an assembler may adjust the tension in first cable 110, e.g., between cable segments 116 of first cable 110, by selecting the appropriate one of blades 324 against which head 312 of block 310 is positioned. For example, the tension in first cable 110 may be increased by engaging head 312 of block 310 against the one of blades 324 closest to the cable segment 116 on which hook 320 is mounted. Thus, blades 324 may be spaced apart along a length of first cable 110 to assist with tension adjustment in first cable 110.

Figure 22:
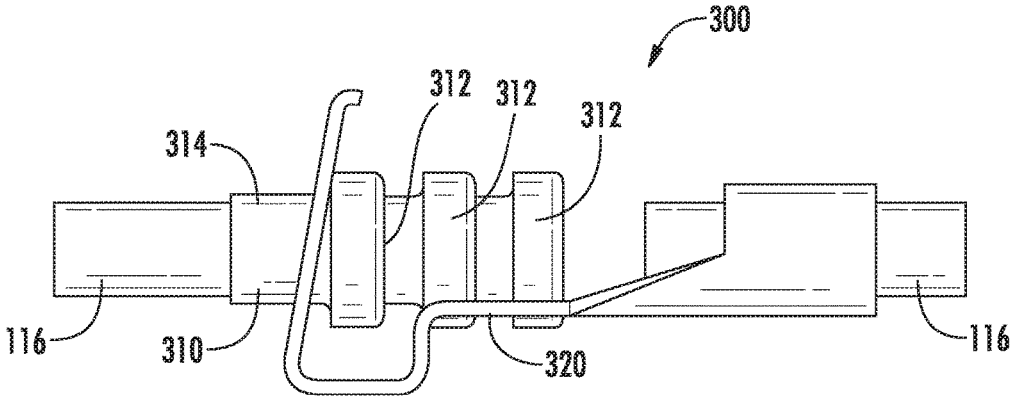
FIG. 22 provides a top, plan view of a connector between two cable segments with a tension adjuster according to a second example embodiment of the present subject matter.

As another example, turning to FIG. 22, block 310 may have a plurality of heads 312. Each head 312 may be positioned on hook 320. During assembly of drawer slide synchronizer 100, an assembler may adjust the tension in first cable 110, e.g., between cable segments 116 of first cable 110, by selecting the appropriate one of heads 312 which engages hook 320. For example, the tension in first cable 110 may be increased by engaging hook 320 with the one of heads 312 of block 310 that is furthest from the cable segment 116 on which hook 320 is mounted. Thus, heads 312 may be spaced apart along a length of first cable 110 to assist with tension adjustment in first cable 110.

Figure 13:
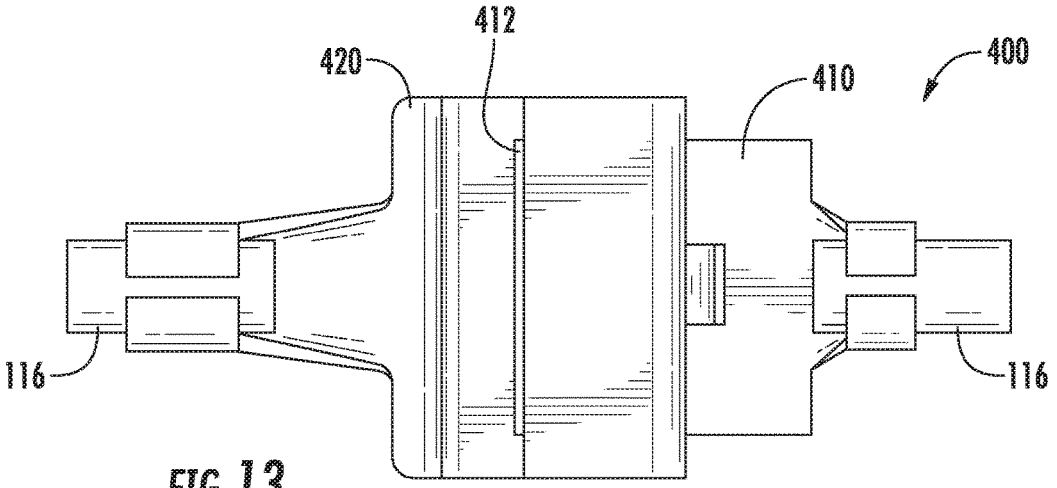
FIGS. 13 and 14 show a connector between two cable segments according to a second example embodiment of the present subject matter.
Figure 14:
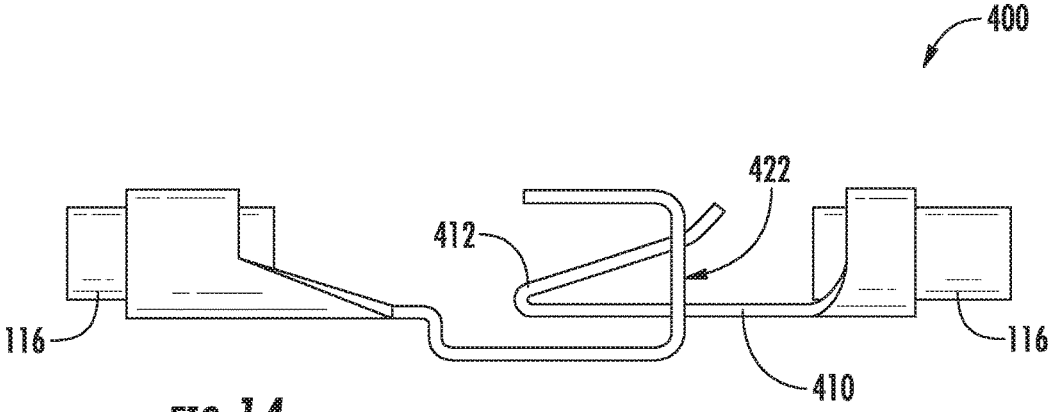

FIGS. 13 and 14 show a connector 400 between cable segments 116 of first cable 110. It will be understood that connector 400 may also be used to connect cable segments 126 of second cable 120 between drawer slides 200. Connector 400 includes a male buckle member 410 and a female buckle member 420. Male buckle member 410 is mounted to one of cable segments 116 of first cable 110, and female buckle member 420 is mounted to the other of cable segments 116 of first cable 110. Male buckle member 410 is received within female buckle member 420 to connect cable segments 116 of first cable 110. For example, as shown in FIGS. 13 and 14, male buckle member 410 may include a clip 412 that elastically deforms as male buckle member 410 is inserted into a slot 422 of female buckle member 420. When male buckle member 410 is fully inserted into slot 422 of female buckle member 420, clip 412 deflects outwardly and the interface between male buckle member 410 and male buckle member 420 couples cable segments 116 of first cable 110 together and prevents cable segments 116 of first cable 110 from separating.

Male buckle member 410 and female buckle member 420 may each be clamped or pinched onto a respective one of cable segments 116 of first cable 110, as shown in FIGS. 13 and 14. In alternative example embodiments, male buckle member 410 and female buckle member 420 may each be tied, adhered, welded, or otherwise suitably attached to the respective one of cable segments 116 of first cable 110. When male buckle member 410 and female buckle member 420 are each mounted to the respective one of cable segments 116 of first cable 110, cable segments 116 of first cable 110 may be positioned coaxial with one another at connector 400. Coaxial positioning of cable segments 116 of first cable 110 may facilitate uniform force transmission through connector 400. Connector 400 may also allow adjustment of tension in first cable 110, e.g., between cable segments 116 of first cable 110.

Figure 23:
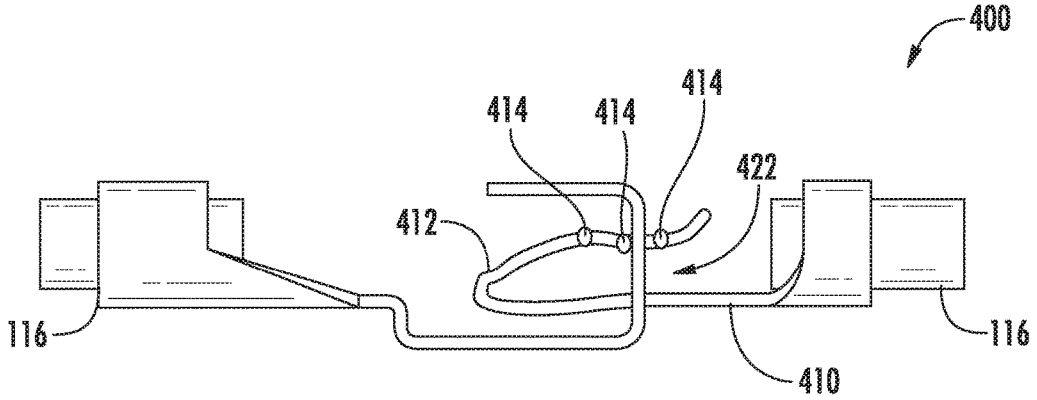
FIG. 23 provides a top, plan view of a connector between two cable segments with a tension adjuster according to a third example embodiment of the present subject matter.

For example, turning to FIG. 23, clip 412 of male buckle member 410 may have a plurality of prongs 414. Each prong 414 may engage with female buckle member 420. During assembly of drawer slide synchronizer 100, an assembler may adjust the tension in first cable 110, e.g., between cable segments 116 of first cable 110, by selecting the appropriate one of prongs 414 which engages female buckle member 420. For example, the tension in first cable 110 may be increased by engaging female buckle member 420 with the one of prongs 414 of male buckle member 410 that is furthest from the cable segment 116 on which female buckle member 420 is mounted. Thus, prongs 414 may be spaced apart along a length of first cable 110 to assist with tension adjustment in first cable 110.

Figure 24:
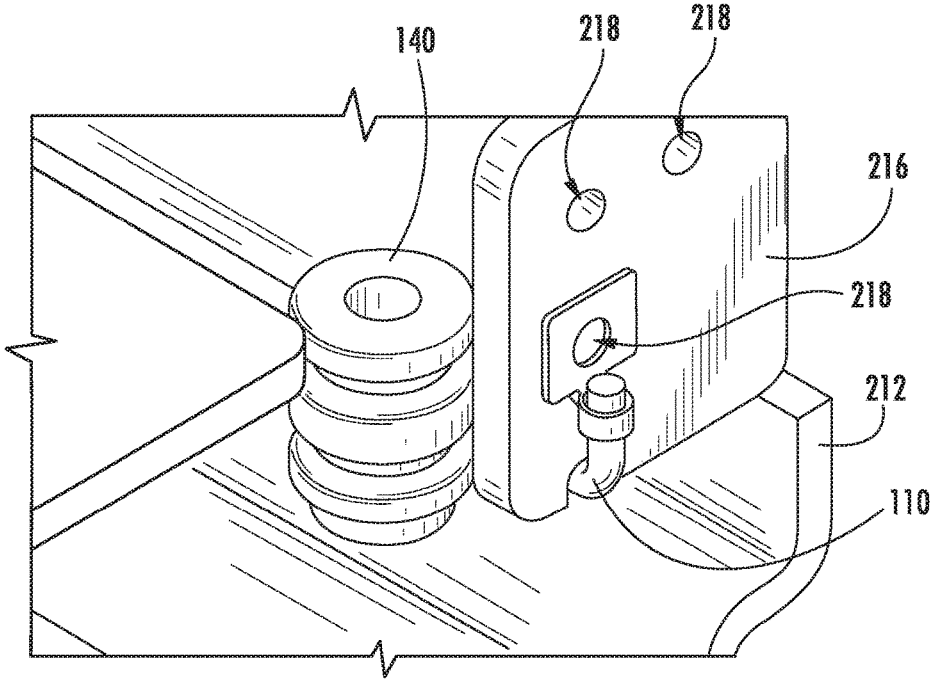
FIG. 24 provides a partial, perspective view of a tension adjuster according to a fourth example embodiment of the present subject matter.

FIG. 24 shows another tension adjustment feature of drawer slide synchronizer 100. As may be seen in FIG. 24, front projection 216 (and/or rear projection 214) may include a plurality of mounting holes 218 for first cable 110. During assembly of drawer slide synchronizer 100, an assembler may adjust the tension in first cable 110, e.g., between cable segments 116 of first cable 110, by selecting the appropriate one of mounting holes 218 for the end of first cable 110. For example, the tension in first cable 110 may be increased by mounting the end of first cable 110 within the mounting hole 218 that is furthest from the opposite end of first cable 110.

Figure 15:
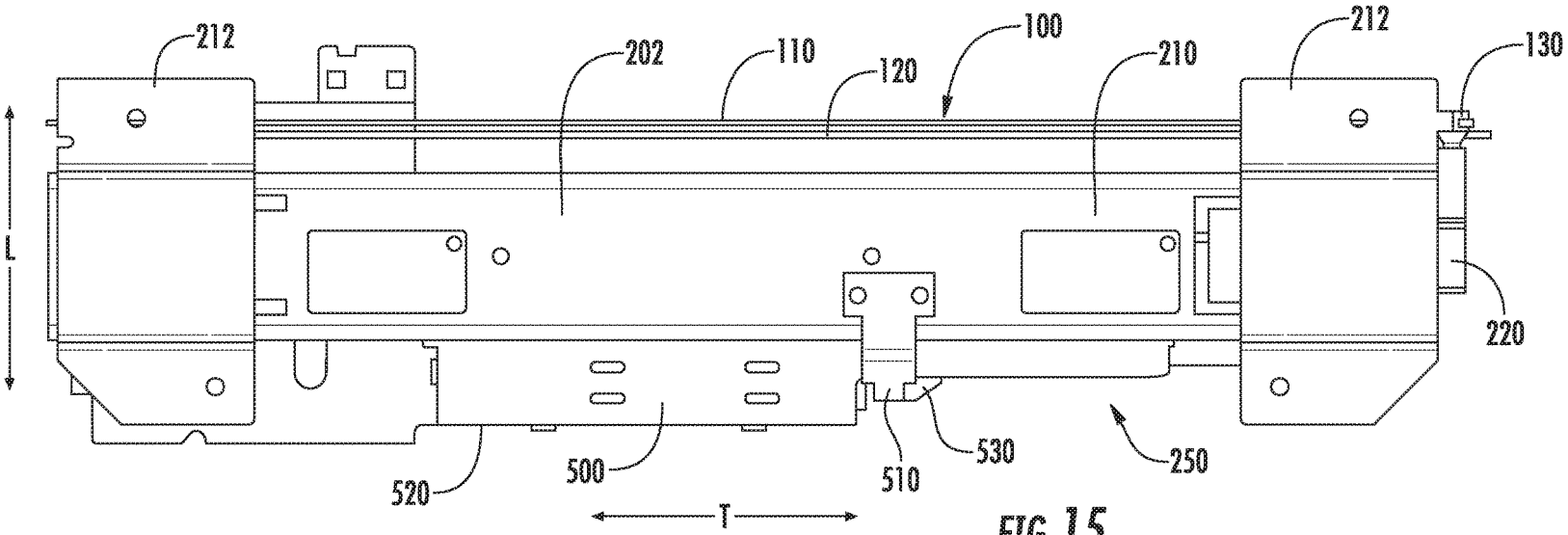
FIGS. 15 and 16 show a drawer slide and a closure assist assembly of the example drawer slide synchronizer of FIG. 3.
Figure 16:
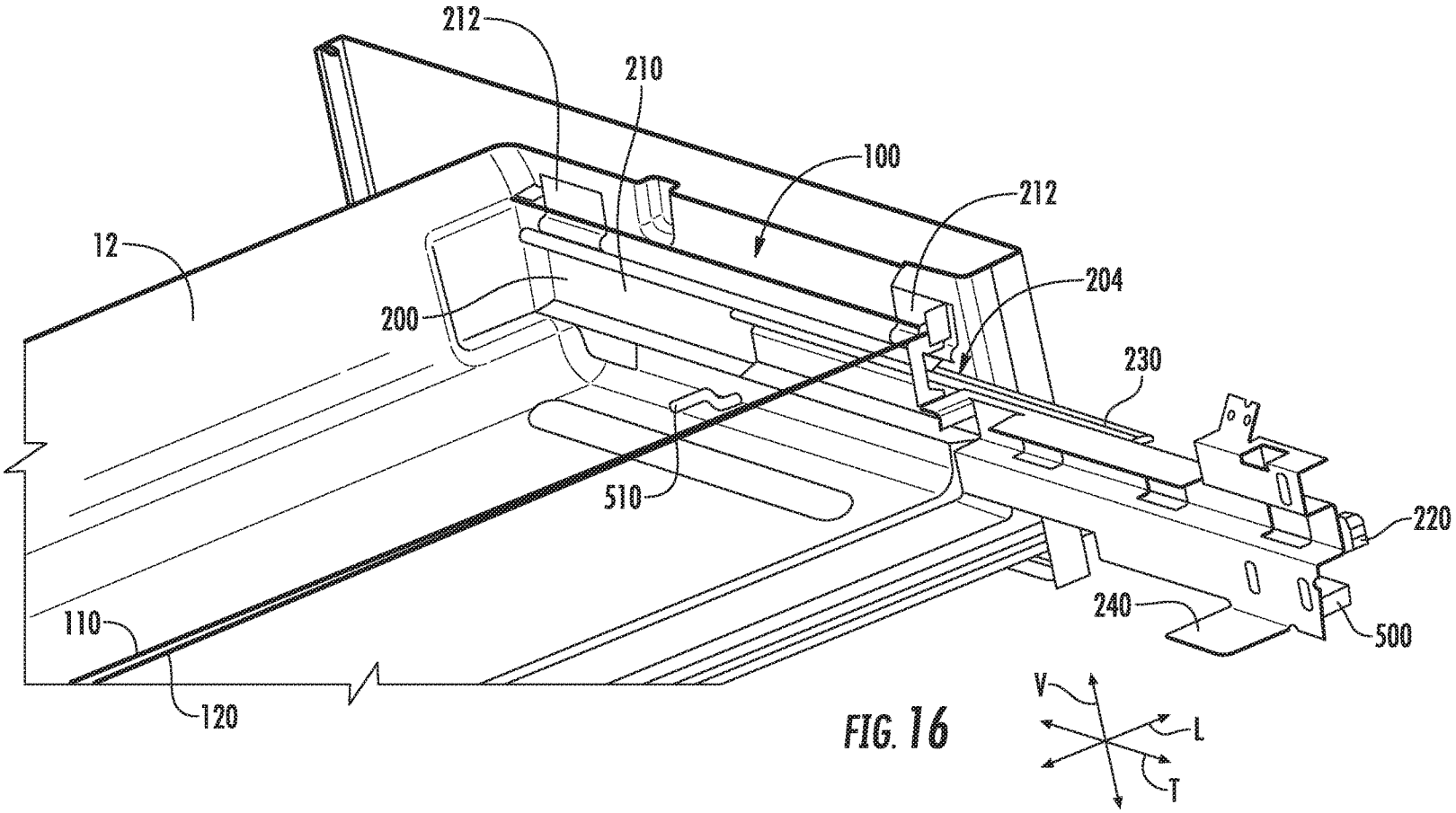

FIGS. 15 and 16 show one of drawer slides 200 and closure mechanism 250. As may be seen in FIGS. 15 and 16, closure mechanism 250 includes a damper 500 and a pin 510. In the example embodiment shown in FIGS. 15 and 16, damper 500 is mounted to one of drawer slides 200 such that damper 500 is fixed relative to the one of drawer slides 200 and translates along the transverse direction T with the one of drawer slides 200. Conversely, pin 510 is mounted to casing 12 such that pin 510 is fixed relative to casing 12. As an example, pin 510 may be formed with or mounted to outer slide 210 because outer slide 210 is fixed relative to casing 12 via outer slide housing 212, e.g., such that pin 510 extends along the lateral direction L away from a side wall of casing 12. As may be seen from the above, damper 500 is translatable along the transverse direction T relative to pin 510 during extension and retraction of drawer slides 200. It will be understood that the positions of damper 500 and pin 510 may be switched in alternative example embodiments. Thus, damper 500 is mounted to casing 12, and pin 510 may be mounted to the one of drawer slides 200, in alternative example embodiments. In addition, a separate closure mechanism 250 may be provided for each drawer slide 200. Thus, refrigerator appliance 10 may include two closure mechanisms 250.

As shown in FIG. 15, damper 500 and pin 510 engage each other when drawer slides 200 are retracted, e.g., and when lower drawer 22 is in the closed position (FIG. 1). Damper 500 and pin 510 may assist with holding lower drawer 22 is in the closed position. Conversely, as shown in FIG. 16, damper 500 and pin 510 may be spaced from each other along the transverse direction T when drawer slides 200 are extended, e.g., and when lower drawer 22 is in the open position (FIG. 2). Damper 500 and pin 510 may assist with providing a controlled, slow and soft closure as lower drawer 22 shifts from the open position to the closed position, as discussed in greater detail below.

Figure 17:
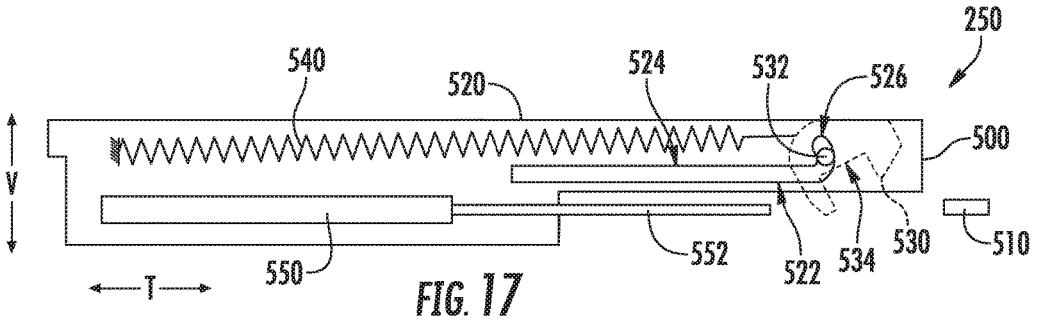
FIGS. 17, 18, 19 and 20 show a damper of the closure assist assembly of FIG. 15.
Figure 18:
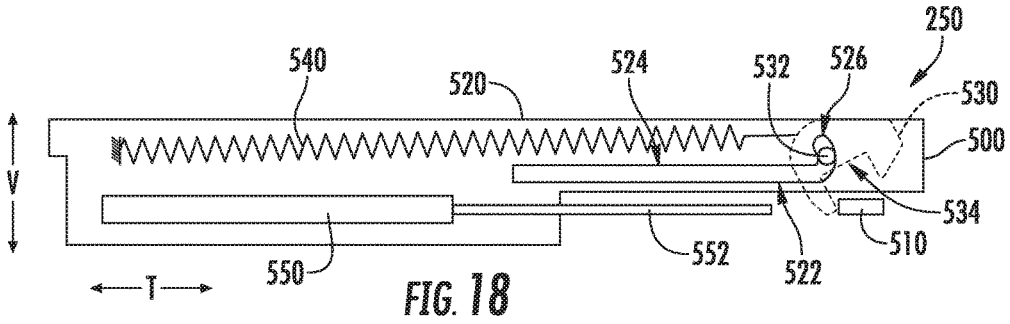
Figure 19:
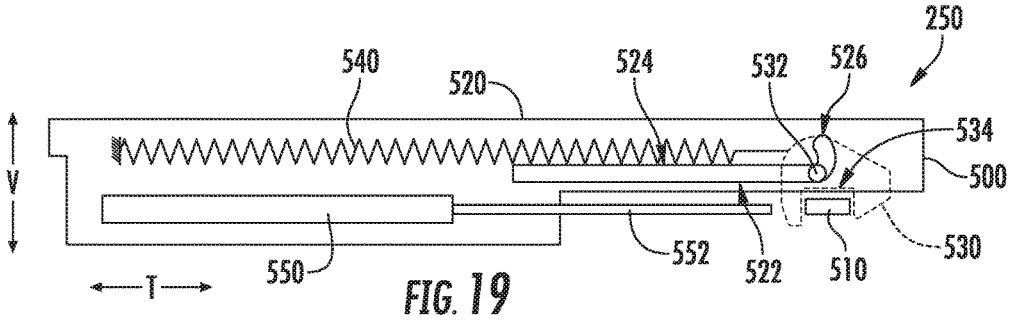

FIGS. 17, 18, 19 and 20 show damper 500 of closure mechanism 250 in various configurations. In FIG. 17, pin 510 is spaced from damper 500, e.g., due to lower drawer 22 being in the open position. FIGS. 18 and 19 show pin 510 during an initial engagement with damper 500 as lower drawer 22 shifts from the open position to the closed position. In FIG. 19, damper 500 engages pin 510, e.g., due to lower drawer 22 being in the closed position. Operation of damper 500 is discussed in greater detail below in the context of FIGS. 17 through 20.

As may be seen in FIGS. 17 through 20, damper 500 includes a casing 520, a latch 530, a spring 540 and a cylinder 550. Latch 530 is mounted to and translates within casing 520. In particular, casing 520 defines a slot 522, and an axle 532 of latch 530 is received within slot 522 such that slot 522 constrains motion of latch 530. In particular, the axle 532 of latch 530 may slide within slot 522, and slot 522 may define a path for motion of latch 530. Slot 522 may include an elongated portion 524 and a curved portion 526. Elongated portion 524 of slot 522 may be positioned closer to back portion 50 of casing 12 (e.g., along the transverse direction T) relative to curved portion 526 of slot 522. Thus, curved portion 526 of slot 522 may be positioned closer to lower drawer 22 (e.g., along the transverse direction T) relative to elongated portion 524 of slot 522. Elongated portion 524 of slot 522 may extend rectilinearly and/or generally horizontal, and curved portion 526 of slot 522 may be arcuate or have any other curved shaped. Curved portion 526 of slot 522 is continuous with elongated portion 524 of slot 522 and may extend upwardly along the vertical direction V from elongated portion 524 of slot 522. Thus, axle 532 of latch 530 may slide between elongated portion 524 of slot 522 and curved portion 526 of slot 522. Elongated portion 524 of slot 522 may guide axle 532 of latch 530 during opening and closing of lower drawer 22, and curved portion 526 of slot 522 may act as a stop or rest for axle 532 of latch 530 when lower drawer 22 is in the open position.

Spring 540 and cylinder 550 are positioned within casing 520 and are coupled to latch 530. Spring 540 and cylinder 550 cooperate to regulate motion of latch 530. In particular, spring 540 urges latch 520 towards an end of elongated portion 524 of slot 522 that is opposite curved portion 526 of slot 522. Thus, spring 540 may assist with urging lower drawer 22 towards the closed position as lower drawer 22 shifts from the open position to the closed position. Cylinder 550 damps the motion of latch 520 towards the end of elongated portion 524 of slot 522 that is opposite curved portion 526 of slot 522. Thus, cylinder 550 may assist with preventing lower drawer 22 from slamming against casing 12 as lower drawer 22 shifts from the open position to the closed position.

Turning to FIG. 17, pin 510 is spaced from damper 500, e.g., due to lower drawer 22 being in the open position. When a user shifts lower drawer 22 from the open position towards the closed position, pin 510 translates towards damper 500 along the transverse direction T until pin 510 impacts latch 530, as may be seen in FIG. 18. Axle 532 of latch 530 is positioned within curved portion 526 of slot 522 when lower drawer 22 is in the open position. Thus, axle 532 of latch 530 may be urged against a wall of curved portion 526 of slot 522 such that the interface between casing 520 and axle 532 of latch 530 prevents spring 540 from pulling latch 530 towards the end of elongated portion 524 of slot 522 that is opposite curved portion 526 of slot 522. When pin 510 impacts latch 530 (e.g., a tooth of latch 530 that forms a catch 534), pin 510 rotates latch 530 so that axle 532 of latch 530 shifts from the curved portion 526 of slot 522 into the elongated portion 524 of slot 522 as shown in FIG. 19. In addition, pin 510 also rotates latch 530 such that pin 510 is received within catch 534 of latch 530 when pin 510 impacts latch 530. When pin 510 is received within catch 534 of latch 530, pin 510 and latch 530 translate together, e.g., due to the interface between pin 510 and latch 530.

Figure 20:
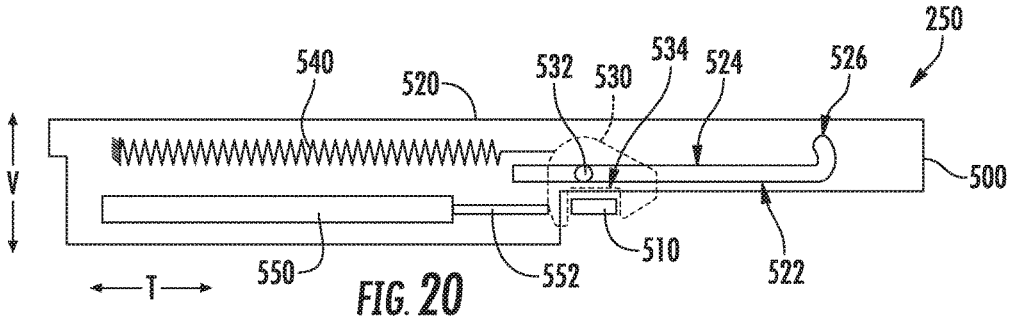

With axle 532 of latch 530 positioned within the elongated portion 524 of slot 522 as shown in FIG. 19, spring 540 urges pin 510 and latch 530 towards the end of elongated portion 524 of slot 522 that is opposite curved portion 526 of slot 522, e.g., due to the lack of inference with casing 520 as when axle 532 of latch 530 is position in curved portion 526 of slot 522. However, pin 510 and/or latch 530 also impact against an extended piston 552 of cylinder 550 as spring 540 urges pin 510 and latch 530. As noted above, cylinder 550 damps the motion of latch 520 towards the end of elongated portion 524 of slot 522 that is opposite curved portion 526 of slot 522. In particular, as spring 540 urges pin 510 and latch 520 towards the end of elongated portion 524 of slot 522 that is opposite curved portion 526 of slot 522, viscous friction of fluid within cylinder 550 may oppose spring 540. Thus, cylinder 550 may be a dashpot or other suitable damper for opposing motion of spring 540. Eventually spring 540 urges pin 510 and latch 530 to the end of elongated portion 524 of slot 522 that is opposite curved portion 526 of slot 522 as shown in FIG. 20. Thus, spring 540 may assist with drawing lower drawer 22 towards the closed position, and cylinder 550 may assist with preventing lower drawer 22 from slamming against casing 12 as lower drawer 22 shifts the open position to the closed position. The operation of damper 500 described above is reversed when a user shifts lower drawer 22 from the closed position to the open position.

The combination of drawer slide synchronizer 100 and closure mechanisms 250 may provide certain benefits. For example, closure mechanisms 250 may prevent the lower drawer 22 from slamming against casing 12 as lower drawer 22 shifts the open position to the closed position and may also prevent lower drawer 22 from bouncing away from casing 12 when lower drawer 22 impacts casing 12. In addition, drawer slide synchronizer 100 may assist with simultaneously engaging two closure mechanisms 250 (left and right hand side closure mechanisms) to allow the two closure mechanisms 250 to operate correctly. Conversely, in current rack and pinion synchronizer systems, the closure mechanisms may not engage simultaneously when a user pulls on a side edge of the lower drawer which can lead to sealing problems between the casing and lower drawer. The combination of drawer slide synchronizer 100 and closure mechanisms 250 may also permit installation of a compression gasket between the casing 12 and lower drawer 22 that assist with sealing a gap between the casing 12 and lower drawer 22 when the lower drawer 22 is closed. Further closure mechanisms 250 may be mounted to an exterior of drawer slides 200 which allows greater extension of drawer slides 200 relative to drawer slides with internal closure mechanisms.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction and a transverse direction that are mutually perpendicular, the refrigerator appliance comprising:

a cabinet extending between a top portion and a bottom portion along the vertical direction, the cabinet also extending between a first side portion and a second side portion along the lateral direction, the cabinet further extending between a front portion and a back portion along the transverse direction, the cabinet defining a chilled chamber;

a chilled chamber drawer assembly comprising a storage bin;

a chilled chamber door;

a pair of drawer slides mounted to the cabinet at a bottom portion of the chilled chamber of the cabinet, the drawer slides of the pair of drawer slides coupling the chilled chamber door to the cabinet such that the chilled chamber door is translatable relative to the cabinet on the pair of drawer slides along the transverse direction;

a pair of flanges, each flange of the pair of flanges mounted to a respective one of the pair of drawer slides such that the pair of flanges are fixed relative to the chilled chamber door, the pair of flanges extending under the storage bin such that the storage bin rests on the pair of flanges;

a drawer slide synchronizer coupling the drawer slides of the pair of drawer slides together, the drawer slide synchronizer comprising a first cable extending between a first end portion and a second end portion, the first end portion of the first cable mounted at the first side portion of the cabinet and the back portion of the cabinet, the second end portion of the first cable mounted at the second side portion of the cabinet and the front portion of the cabinet, the first cable comprising a pair of cable segments and a connector between the cable segments of the pair of cable segments of the first cable, the cable segments of the pair at cable segments of the first cable coupled to each other between the drawer slides of the pair of drawer slides, the connector comprising a block and a hook, the block mounted to one of the pair of cable segments of the first cable, the hook mounted to the other of the pair of cable segments of the first cable, the block comprising a plurality of heads, each head of the plurality of heads positionable on the hook, a tension in the first cable adjustable by changing a respective head engaged with the hook;

a second cable extending between a first end portion and a second end portion, the first end portion of the second cable mounted at the second side portion of the cabinet and the back portion of the cabinet, the second end portion of the second cable mounted at the first side portion of the cabinet and the front portion of the cabinet;

a first bearing mounted to a first one of the pair of drawer slides such that the first bearing is fixed relative to the chilled chamber door, the first and second cables contacting the first bearing;

a second bearing mounted to a second one of the pair of drawer slides such that the second bearing is fixed relative to the chilled chamber door, the first and second cables contacting the second bearing; and a closure assist assembly having a damper and a pin, the damper mounted to one of the pair of drawer slides or to the cabinet, the pin mounted to the other of the one of the pair of drawer slides or to the cabinet, the pin engageable by the damper when the door translates from an open position towards a closed position.

2. The refrigerator appliance of claim 1, wherein the damper of the closure assist assembly comprises a latch coupled to a spring and a cylinder with a fluid, the latch engaging the pin when the door translates from the open position towards the closed position.

3. The refrigerator appliance of claim 1, wherein the first cable turns on the first bearing and then the second bearing between the first and second end portions of the first cable, wherein the second cable turns on the second bearing and then the first bearing between the first and second end portions of the first cable.

4. The refrigerator appliance of claim 3, wherein the first and second cables cross each other between the drawer slides of the pair of drawer slides.

5. The refrigerator appliance of claim 3, wherein the first and second cables do not cross each other between the drawer slides of the pair of drawer slides.

6. The refrigerator appliance of claim 1, wherein the first bearing is a pulley that defines a pair of grooves, the first and second cables each positioned within a respective one of the pair of grooves.

7. The refrigerator appliance of claim 6, wherein the grooves of the pair of grooves are spaced apart from each other along the vertical direction.

8. The refrigerator appliance of claim 1, wherein the first and second end portions of the first cable and the first and second end portions of the second cable are fixed relative to the cabinet.

9. The refrigerator appliance of claim 1, wherein the second cable comprises a pair of cable segments, the cable segments of the pair of cable segments of the second cable coupled to each other between the drawer slides of the pair of drawer slides.

10. The refrigerator appliance of claim 9, wherein the connection between the cable segments of the pair of cable segments of the first cable is positioned proximate the second side portion of the cabinet and a connection between the cable segments of the pair of cable segments of the second cable is positioned proximate the first side portion of the cabinet.

11. The refrigerator appliance of claim 1, wherein each drawer slide of the pair of drawer slides comprises:

a first slide fixed relative to the cabinet;

a second slide fixed relative to the chilled chamber door; and a third slide coupled to first and second slides, wherein the second and third slides are moveable along the transverse direction relative to the first slide on ball bearings.

12. The refrigerator appliance of claim 11, wherein the first end portion of the first and second cables are mounted to a respective first slide of the pair of drawer slides.

13. The refrigerator appliance of claim 11, wherein each drawer slide of the pair of drawer slides further comprises a first slide holder coupling the first slide to the cabinet, the first end portion of the first and second cables mounted to a respective first slide holder of the pair of drawer slides.

14. The refrigerator appliance of claim 1, wherein the first end portion of the first and second cables are mounted directly to that cabinet at the back portion of the cabinet.

15. The refrigerator appliance of claim 1, wherein the chilled chamber drawer assembly comprises a projection mounted to one of the cabinet and the chilled chamber door such that the projection is fixed relative to the one of the cabinet and the chilled chamber door, the projection defining a plurality of holes, one of the first and second end portions of the first cable mountable to each hole of the plurality of holes, the tension in the first cable adjustable by changing a respective hole of the plurality of holes to which the first cable is mounted.

16. A refrigerator appliance defining a vertical direction, a lateral direction and a transverse direction that are mutually perpendicular, the refrigerator appliance comprising:

a cabinet extending between a top portion and a bottom portion along the vertical direction, the cabinet also extending between a first side portion and a second side portion along the lateral direction, the cabinet further extending between a front portion and a back portion along the transverse direction, the cabinet defining a chilled chamber;

a chilled chamber drawer assembly comprising a storage bin;

a chilled chamber door;

a pair of drawer slides mounted to the cabinet at a bottom portion of the chilled chamber of the cabinet, the drawer slides of the pair of drawer slides coupling the chilled chamber door to the cabinet such that the chilled chamber door is translatable relative to the cabinet on the pair of drawer slides along the transverse direction;

a pair of flanges, each flange of the pair of flanges mounted to a respective one of the pair of drawer slides such that the pair of flanges are fixed relative to the chilled chamber door, the pair of flanges extending under the storage bin such that the storage bin rests on the pair of flanges;

a drawer slide synchronizer coupling the drawer slides of the pair of drawer slides together, the drawer slide synchronizer comprising a first cable extending between a first end portion and a second end portion, the first end portion of the first cable mounted at the first side portion of the cabinet and the back portion of the cabinet, the second end portion of the first cable mounted at the second side portion of the cabinet and the front portion of the cabinet, the first cable comprising a pair of cable segments and a connector between the cable segments of the pair of cable segments of the first cable, the cable segments of the pair of cable segments of the first cable coupled to each other between the drawer slides of the pair of drawer slides, the connector comprising a male buckle member and a female buckle member, the male buckle member mounted to one of the pair of cable segments of the first cable, the female buckle member mounted to the other of the pair of cable segments of the first cable, the male buckle member received within the female buckle member to connect the pair of cable segments of the first cable, a clip of the male buckle member comprising a plurality of prongs, each prong of the plurality of prongs engageable with the female buckle member, a tension in the first cable adjustable by changing a respective prong engaged with the female buckle member;

a second cable extending between a first end portion and a second end portion, the first end portion of the second cable mounted at the second side portion of the cabinet and the back portion of the cabinet, the second end portion of the second cable mounted at the first side portion of the cabinet and the front portion of the cabinet;

a first bearing mounted to a first one of the pair of drawer slides such that the first bearing is fixed relative to the chilled chamber door, the first and second cables contacting the first bearing;

a second bearing mounted to a second one of the pair of drawer slides such that the second bearing is fixed relative to the chilled chamber door, the first and second cables contacting the second bearing; and a closure assist assembly having a damper and a pin, the damper mounted to one of the pair of drawer slides or to the cabinet, the pin mounted to the other of the one of the pair of drawer slides or to the cabinet, the pin engageable by the damper when the door translates from an open position towards a closed position.

17. A refrigerator appliance defining a vertical direction, a lateral direction and a transverse direction that are mutually perpendicular, the refrigerator appliance comprising:

a cabinet extending between a top portion and a bottom portion along the vertical direction, the cabinet also extending between a first side portion and a second side portion along the lateral direction, the cabinet further extending between a front portion and a back portion along the transverse direction, the cabinet defining a chilled chamber;

a chilled chamber drawer assembly comprising a storage bin;

a chilled chamber door;

a pair of drawer slides mounted to the cabinet at a bottom portion of the chilled chamber of the cabinet, the drawer slides of the pair of drawer slides coupling the chilled chamber door to the cabinet such that the chilled chamber door is translatable relative to the cabinet on the pair of drawer slides along the transverse direction;

a pair of flanges, each flange of the pair of flanges mounted to a respective one of the pair of drawer slides such that the pair of flanges are fixed relative to the chilled chamber door, the pair of flanges extending under the storage bin such that the storage bin rests on the pair of flanges;

a drawer slide synchronizer coupling the drawer slides of the pair of drawer slides together, the drawer slide synchronizer comprising a first cable extending between a first end portion and a second end portion, the first end portion of the first cable mounted at the first side portion of the cabinet and the back portion of the cabinet, the second end portion of the first cable mounted at the second side portion of the cabinet and the front portion of the cabinet, the first cable comprising a pair of cable segments and a connector between the cable segments of the pair of cable segments of the first cable, the cable segments of the pair at cable segments of the first cable coupled to each other between the drawer slides of the pair of drawer slides, the connector comprising a block and a hook, the block mounted to one of the pair of cable segments of the first cable, the hook mounted to the other of the pair of cable segments of the first cable, the hook comprising a plurality of blades, each blade of the plurality of blades having a slot within which a shaft of the block is receivable, a tension in the first cable adjustable by changing a respective blade engaged with the block;

a second cable extending between a first end portion and a second end portion, the first end portion of the second cable mounted at the second side portion of the cabinet and the back portion of the cabinet, the second end portion of the second cable mounted at the first side portion of the cabinet and the front portion of the cabinet;

a first bearing mounted to a first one of the pair of drawer slides such that the first bearing is fixed relative to the chilled chamber door, the first and second cables contacting the first bearing;

a second bearing mounted to a second one of the pair of drawer slides such that the second bearing is fixed relative to the chilled chamber door, the first and second cables contacting the second bearing; and a closure assist assembly having a damper and a pin, the damper mounted to one of the pair of drawer slides or to the cabinet, the pin mounted to the other of the one of the pair of drawer slides or to the cabinet, the pin engageable by the damper when the door translates from an open position towards a closed position.

* * * * *